United States Patent [19]

Mansfield

[11] 4,031,618

[45] June 28, 1977

[54] ELECTRIC SHAVER

[76] Inventor: Robin Mansfield, 14850 Oka Road No. 31, Los Gatos, Calif. 95030

[22] Filed: Jan. 15, 1976

[21] Appl. No.: 649,314

[52] U.S. Cl. ..... 30/41.5; 30/43.6; 30/41

[51] Int. Cl.[2] ..... B26B 19/44

[58] Field of Search ..... 30/41, 415, 133, 43.6

[56] References Cited

UNITED STATES PATENTS

| | | | |
|---|---|---|---|
| 1,519,504 | 12/1924 | Pando | 30/41 X |
| 2,461,858 | 2/1949 | Towers | 30/41.5 X |
| 3,103,299 | 9/1963 | Werft | 30/41 X |
| 3,359,634 | 12/1967 | Beck | 30/41 |

*Primary Examiner*—Gary L. Smith

[57] ABSTRACT

An electric dry shaver has a shaving head assembly provided with reel-type cutters, a vacuum system within the casing of the shaver both for drawing individual hairs into cutting position and exhausting cut hairs from the casing; and integral lotion dispensing means for dispensing lotion automatically to the shaving head assembly.

4 Claims, 4 Drawing Figures

ELECTRIC SHAVER

BACKGROUND OF INVENTION

The present invention relates in general to dry shavers of the type having power operated means for creating a vacuum within the casing of the shaver both for drawing individual hairs into cutting position and exhausting cut hairs from the shaver. Typical of dry shavers of this type are those illustrated by U.S. Pat. No. 2,802,260, Allen, 8/13/57 and U.S. Pat. No. 2,824,367, McWilliams, 2/25/58. Other dry shavers having vacuum systems for collecting cut hairs are illustrated by U.S. Pat. No. 2,716,279, Peterson, 8/30/55, U.S. Pat. No. 2,950,530, Fox, 8/30/60 and U.S. Pat. No. 3,571,926, Ainsworth, 3/23/71.

SUMMARY OF INVENTION

The dry shaver of the instant invention is an improvement over the dry shavers of the prior art in that it embodies a vacuum system in combination with means for automatically dispensing a lotion to the shaving head when the shaver is being used; and in particular to a dry shaver having over-and-under reel-type cutters, an object of the invention being to provide a dry shaver which will apply a lotion to the shaver's skin at the same time the individual hairs are being cut thereby simultaneously softening the hairs and reducing friction at the interface of the shaving head and shaver's skin thus insuring a more comfortable shave and less irritation to the skin. Moreover the integral lotion dispensing chamber eliminates carrying shaving lotion in a separate container — which is particularly advantageous when traveling; while the reel-type cutters effect a clean shearing action that precludes pulling the hairs or pinching the skin.

DESCRIPTION OF PREFERRED EMBODIMENT

Figure 1:
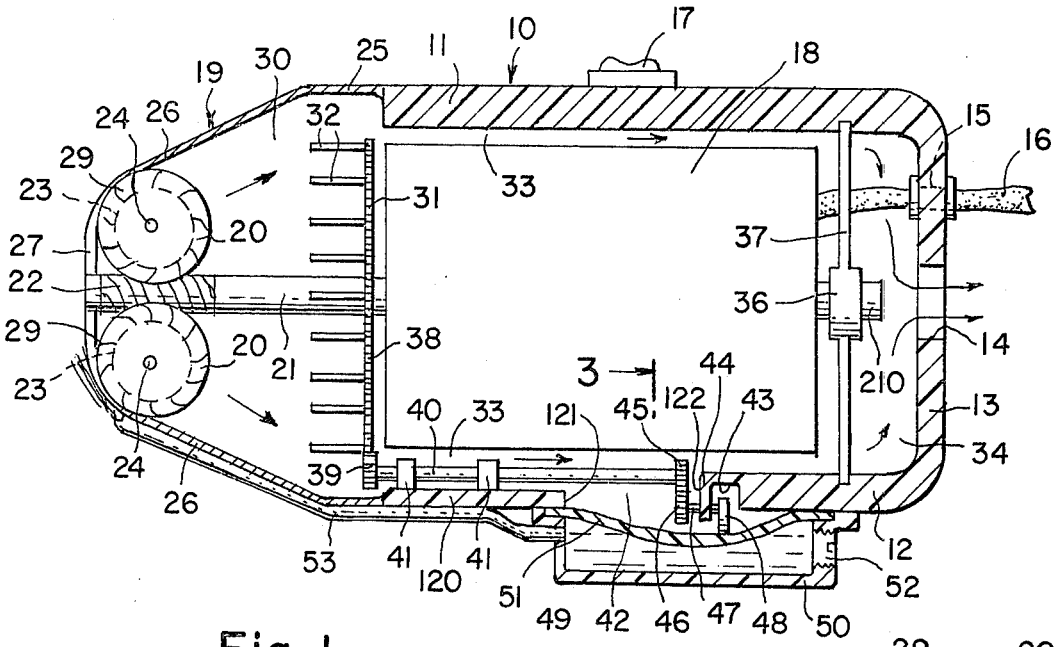
FIG. 1 is a vertical elevation, in section, of the improved dry shaver of this invention.

In the drawings which, for purposes of illustration show a preferred form of the invention, the casing of the dry shaver is indicated generally at 10 and comprises a companion pair of opposed casing sections, indicated in FIG. 1 as the upper section 11 and lower section 12, each comprising substantially one half of a hollow cup-shaped cylinder and both adapted to be secured together by any conventional fastening means to form the cup-shaped casing 10. The casing may be formed of a lightweight metal such as aluminum, an aluminum alloy or magnesium; or may be a suitable plastic material.

The rear wall of the cup-shaped casing is indicated at 13 and has a central aperture 14, sometimes referred to hereinafter as a discharge port; and an axially offset aperture 15 adapted to accomodate an electric cord 16 the inner end of which is connected by way of an on-off switch 17 to drive means in the form of an electric motor 18. The opposite end of the cord 16 is adapted to be connected to a conventional power source i.e. house circuit, not shown.

Figure 2:
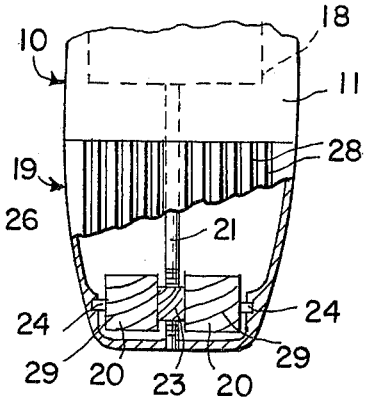
FIG. 2 is a fragmentary plan view of the shaving head assembly of FIG. 1 partially broken away to show one of the reel-type cutters.

The forward end of the casing 10 is open and mounted on the open forward end of the casing is a shearing head assembly comprising a nose-piece, indicated generally at 19, a pair of cylindrical reel-type cutters 20—20 arranged in over-and-under relationship, and cutter drive means in the form of shaft 21 extending forwardly from the front end of the motor 18. The forward extremity of the drive shaft 21 extends between the cutters 20—20 and is rotatably mounted in a suitable bearing in the front wall of the nose-piece 19. The portion of the drive shaft between the over-and -under cutters 20—20 comprises a worm gear 22 which, as shown in FIGS. 1 and 2, is in driving engagement with each reel-type cutter 20 by way of worm gears 23, the latter constituting integral reduced portions of the corresponding cutters intermediate opposite endsthereof. Opposite ends of each cutter are provided with axial trunnions 24—24 by which each cutter is rotatably supported in the forward end of the nose-piece 19.

The nose-piece 19 may be formed of metal or plastic and has the shape of a truncated cone, the base portion 25 of which is adapted to be detachably secured to the forward open end of the casing 10 by resilient clips of equivalent fastening means (not shown). As shown in FIG. 1 the wall of the nose-piece tapers in thickness from its relatively thick base portion 25 to extremely thin sections 26—26 opposite the cutters — beyond which the wall thickness is increased as at 27 to provide support for the forward end of the drive shaft 21.

Figure 4:
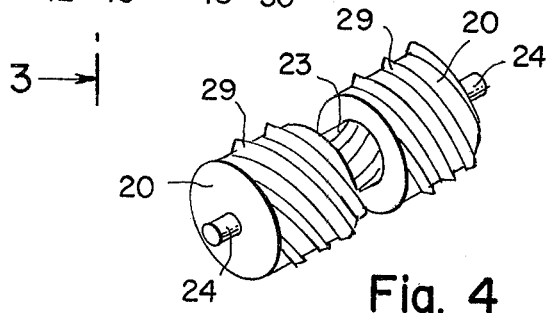
FIG. 4 is a perspective view of one of the two reel-type cutters.
Figure 3:
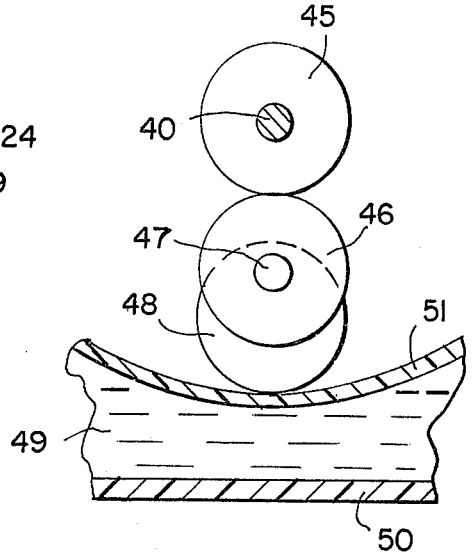
FIG. 3 is section of the shaver on line 3—3 of FIG. 1.

Referring again to FIG. 2 the top and bottom surfaces of the nose-piece 19 comprise cutter guard means 26—26 and are substantially flat and provided with a plurality of laterally spaced parallel slots 28, see FIG. 2, which permit the hairs to pass therethrough into the path of the reel-type cutters and more particularly the cutting blades which project therefrom, yet preclude the cutting blades from contacting the skin from which the hairs project. As shown especially well in FIG. 4 each cutter is essentially a solid metal cylinder having a plurality of slightly curved cutter blades 29 projecting from the surface thereof the cutter blades 29 extending longitudinally of the cylindrical cutters and disposed therearound in substantially spaced parallel relationship with the longitudinal axis of each blade making an acute angle to the longitudinal axis of the cutter.

Referring to FIG. 1, the portion of the nose-piece rearwardly of the cutters constitutes a plenum or vacuum chamber 30. Supported in the vacuum chamber on drive shaft 21 is a vacuum impeller 31 which is adapted to be rotated rapidly to create a vacuum force within the chamber 30 for drawing individual hairs into cutting position and expelling cut hairs from the shaver as hereinafter described. To this end the impeller 31 comprises a substantially flat disc of suitable material such as metal or plastic from the forward face of which project a plurality of vanes 32 so oriented that, when rotated, air is expelled from the vacuum chamber and forced rearwardly by way of annular air passage 33 between motor 18 and casing 10, to a collection chamber 34 at the rear of the motor 18, the air, together with any cut hairs, being discharged from the chamber 34 by way of discharge port 14.

As mentioned above the forward end of the drive shaft 21 of motor 18 is rotatably supported in the front wall 27 of nose-piece 19. Support for the rear end of the motor 18 is provided by an extension 210 of the motor shaft which extension is rotatably supported in a bearing 36 mounted in a spider 37 fixedly secured in the aforesaid collection chamber 34.

Turning again to the vacuum impeller 31, the latter constitutes one element of lotion dispensing means adapted to be actuated automatically to dispense a shaving lotion or the like to the shaving head and in particular the interface between the cutting blades and the cutter guards 26—26. To this end the periphery of the vacuum impeller 31 is formed with gear teeth 38. The latter are adapted to engage the teeth of a spur gear 39 keyed to the forward end of shaft 40 rotatably supported by bearing blocks 41—41 in the annular space between the motor and casing section 12.

To provide clearance for the aforesaid spur gear and shaft assembly the lower section 12 of the casing 10 is formed with a thin section 120 which, in effect, enlarges the annular passage 33 at this point in the casing. Further, the relatively thin section 120 is terminated rearwardly as at 121 by an aperture 42 formed in the bottom section 12 of the casing, the rear edge or rim of the aperture being identified by the numeral 122. Formed in the underside of casing section 12 rearwardly of rim 122 of aperture 42 is a relief recess 43 which, in effect, forms a depending bearing post 44 with the rim 122 of aperture 42 as and for the purpose hereinafter described.

Keyed to the rear extremity of shaft 40 opposite aperture 42 is a second spur gear 45. The latter is adapted to engage spur gear 46 keyed to the forward end of a stud-shaft 47 rotatably mounted intermediate its opposite ends, and in spaced parallel relationship to shaft 40, in the aforesaid gearing post 44. Keyed to the rear end of stud shaft 47 within the relief recess 43 is a cam 48. Thus when the vacuum impeller 31 is rotated it drives the aforesaid spur gear and shaft assembly to cause the cam 48 to rotate freely within the relief recess 43.

Persuant to the objects of this invention rotation of the cam 48 is adapted to dispense a lotion to the shaving head 19. To this end a lotion-containing chamber 49 is afixed in any suitable manner as for example by welding, soldering, machine screws or the like, to the underside of the lower section 12 of the casing opposite the aperture 42. The lotion-containing chamber 49 is a relatively shallow receptacle 50 the top or cover 51 of which comprises a flexible membrane of any suitable material such as woven fabric, flexible plastic or thin metal. A screw thread plug 52 is provided in the rear wall of the receptacle for recharging the lotion-chamber when necessary.

Extending forwardly from the front wall of the receptacle 50 is a relatively fine, i.e. small diameter, dispensing tube 53 the forward end of which is arranged to be afixed to and terminate beneath and immediately adjacent the forward extremity of the cutter guard 26, as seen in FIG. 1.

Thus, when the switch 17 is moved to "on" position the motor 18 is energized to rotate the reel-type cutters 20—20 and vacuum impeller 31. Simultaneously the latter motivates the spur gear and shaft assembly thereby rotating cam 48 which successively engages and disengages the flexible membrane 51 thereby effecting a pumping action which propels lotion from the chamber 49 to the shearing head and in particular the interface of the cutting blades and cutter guard. Lotion is thus automatically brought to the shaving head for moistening the skin and soften the individual hairs. Further, the vacuum force created by the impeller 31 tends to draw the skin against the cutter guard thus forcing the hairs through the slots of the cutter guard for engagement by the cutter blades. The cut hairs are immediately drawn rearwardly by the force of the vacuum created in the vacuum chamber 30 to the discharge chamber 34 at the rear end of the casing from which the hairs are discharged by way of the discharge port 14.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. An electric dry shaver comprising a casing, a shaving head assembly arranged at the forward end of said casing, said shaving head assembly comprising a slotted cutter guard, a pair of cylindrical reel-type cutters each cylindrical reel-type cutter having an integral worm gear intermediate opposite ends thereof, trunnions at opposite ends, respectively, of each cylindrical cutter arranged to rotatably mount said cylindrical reel-type cutters in over-and-under spaced parallel relationship within said slotted cutter guard with the longitudinal axis of each cylindrical cutter at substantially right angles to the slots in said slotted cutter guard, a vacuum chamber in said shaving head assembly rearwardly of said cylindrical reel-type cutters, a motor mounted within said casing rearwardly of said vacuum chamber, said motor having a drive shaft arranged to extend forwardly into said shaving head assembly, a worm gear integral with the forward end of said drive shaft the said worm gear of said drive shaft arranged in driving engagement with the respective worm gears of said cylindrical reel-type cutters thereby to rotate said cylindrical reel-type cutters, a disc-like vacuum impeller afixed to said drive shaft within said vacuum chamber, a discharge port in the rear end of said casing, internal passage within said casing arranged to connect said vacuum chamber to said discharge port, said drive shaft arranged to rotate said disc-like vacuum impeller to create a vacuum force within said shaving head assembly.

2. An electric dry shaver according to claim 1 wherein the forward end of said motor drive shaft is rotatably supported by said cutter guard in driving engagement with said reel-type cutters.

3. An electric dry shaver according to claim 2 wherein said rotating disc-type impeller is provided with fins and arranged to create a vacuum force in said vacuum chamber sufficient to draw individual hairs into cutting position and to exhaust cut hairs from said vacuum chamber by way of said internal passages and the discharge port of said casing.

4. An electric dry shaver according to claim 1 wherein said casing is constructed and arranged with lotion dispensing means comprising a chamber having a flexible wall, a conduit arranged to connect the lotion chamber to said shaving head assembly, and rotatable means arranged to be actuated automatically by said disc-like vacuum impeller to engage and deflect the said flexible wall of said lotion chamber thereby to dispense lotion therefrom to said shaving head assembly.

* * * * *